US010756475B2

(12) United States Patent
Tiemann et al.

(10) Patent No.: US 10,756,475 B2
(45) Date of Patent: Aug. 25, 2020

(54) HOLDING FRAME FOR A HEAVY PLUG-TYPE CONNECTOR

(71) Applicant: HARTING Electric GmbH & Co. KG, Espelkamp (DE)

(72) Inventors: Andre Tiemann, Bad Essen (DE); Heiko Meier, Minden (DE); Jörg Ziegenhahn, Büren (DE); Andre Beneke, Vechta (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/486,543

(22) PCT Filed: Apr. 11, 2018

(86) PCT No.: PCT/DE2018/100329

§ 371 (c)(1),
(2) Date: Aug. 16, 2019

(87) PCT Pub. No.: WO2018/192615

PCT Pub. Date: Oct. 25, 2018

(65) Prior Publication Data

US 2020/0059034 A1 Feb. 20, 2020

(30) Foreign Application Priority Data

Apr. 20, 2017 (DE) ..... 10 2017 108 430

(51) Int. Cl.
*H01R 13/514* (2006.01)
*H01R 13/518* (2006.01)
*H01R 13/627* (2006.01)

(52) U.S. Cl.
CPC ..... *H01R 13/518* (2013.01); *H01R 13/514* (2013.01); *H01R 13/6273* (2013.01)

(58) Field of Classification Search
CPC . H01R 13/514; H01R 13/518; H01R 13/6278
See application file for complete search history.

(56) References Cited

U.S. PATENT DOCUMENTS 3,559,813 A * 2/1971 Sosinski ..... H05K 7/02 211/89.01
3,576,520 A * 4/1971 Stauffer ..... H01R 9/26 439/716

(Continued)

FOREIGN PATENT DOCUMENTS

CN 203326246 U 12/2013
CN 105428919 A 3/2016

(Continued)

*Primary Examiner* — Renee S Luebke
*Assistant Examiner* — Milagros Jeancharles
(74) *Attorney, Agent, or Firm* — Smartpat PLC

(57) ABSTRACT

A holding frame for a heavy plug-type connector can receive identical and/or different plug-type connector modules. The holding frame comprises a main body which has two side parts which lie opposite one another, and at least one fixing clip which is held at least on a side part, and by way of which the plug-type connector modules can be fixed within the main body. The at least one fixing clip has at least one holding arm which moves parallel to the plane of the side parts during the introduction of a plug-type connector module into the holding frame. As a result, plug-type connector modules can be introduced into the holding frame particularly simply and even in the installed state of said holding frame. At the same time, the holding frame variant which is shown here is more stable than the previously known holding frames which have the same functionality.

15 Claims, 4 Drawing Sheets

(56) References Cited

U.S. PATENT DOCUMENTS 4,032,209 A * 6/1977 Rutkowski ..... H01R 9/26 439/355
4,611,879 A * 9/1986 Bullard ..... H01R 13/514 439/715
4,735,583 A * 4/1988 Rudy, Jr. ..... H01R 13/518 439/350
5,282,179 A * 1/1994 Vuilleumier ..... G04B 19/247 368/28
5,382,179 A * 1/1995 Noschese ..... H01R 13/6275 439/369
5,429,525 A * 7/1995 McCoy ..... H01R 13/627 439/352
5,595,507 A * 1/1997 Braun ..... H01R 4/64 439/716
5,695,355 A * 12/1997 Hasenfratz ..... H01R 13/6275 439/353
5,795,174 A 8/1998 Saito et al.
6,123,554 A * 9/2000 Ortega ..... H01R 13/514 439/701
6,139,366 A * 10/2000 van Woensel ..... H01R 13/6275 439/607.19
6,361,374 B1 * 3/2002 Lloyd ..... H01R 13/518 439/607.12
6,619,997 B1 * 9/2003 Wilson ..... H01R 9/2416 439/371
7,316,591 B2 * 1/2008 Ferderer ..... H01R 13/506 439/532
7,488,202 B2 * 2/2009 Spitaels ..... H01R 13/741 439/532
10,178,790 B2 * 1/2019 Unger ..... H01R 13/62905
10,411,377 B2 * 9/2019 Kawahara ..... H01R 12/707
10,418,773 B2 * 9/2019 Herbrechtsmeier ... H01R 43/20
10,530,090 B2 * 1/2020 Wolff ..... H01R 13/514
2015/0333441 A1 11/2015 Annis et al.
2018/0248299 A1 * 8/2018 Wolffle ..... H01R 13/518
2019/0334278 A1 * 10/2019 Wolff ..... H01R 13/506
2020/0106205 A1 * 4/2020 Carr, Jr. ..... H01R 13/514

FOREIGN PATENT DOCUMENTS

CN 206098894 U 4/2017
DE 102013113976 10/2016
DE 202015106434 U1 3/2017
EP 2945229 A1 11/2015
JP H08273753 A 10/1996
JP 2010080083 A 4/2010
WO 2017036928 A1 3/2017

* cited by examiner

HOLDING FRAME FOR A HEAVY PLUG-TYPE CONNECTOR

TECHNICAL FIELD

The disclosure relates to a holding frame for a heavy plug-type connector. Holding frames of this type are required in order to receive multiple identical and/or also different modules. These modules may be by way of example insulating bodies that are provided for electronic and electrical and possibly also for optical and/or pneumatic contacts.

BACKGROUND

DE 10 2013 113 976 B4 discloses a holding frame for a heavy plug-type connector for receiving identical and/or different plug-type connector modules. The holding frame comprises a base body that has two side parts that lie opposite one another. A cheek part that is embodied from a flexible material is attached to each side part. As a plug-type connector module is being inserted into the holding frame, these cheek parts are bent outward away from the side part, as a result of which the plug-type connector modules are fixed within the base body in one plane.

Such a holding frame may be fitted out in a particularly simple manner with different plug-type connector modules.

However, it has been shown in practice that using the above-mentioned cheek parts to fix the plug-type connector modules does not meet the requirements of some industrial fields. When using the cheek parts to fix the plug-type connector modules, said plug-type connector modules often experience too great a play within the base body of the holding frame. As a result, excessively high plugging and pulling forces frequently occur. The contact elements are able to tilt during the plugging-in procedure, as a result of which greater wear occurs and after some time there is the risk of an overvoltage arc.

Moreover, holding frames are subjected to mechanical loading in rough industrial environments. In the industrial environment, heavy plug-type connectors having installed holding frames may fall out accidentally. The flexible cheek parts are adversely affected by this and are often bent. Such a holding frame loses its functionality and must be replaced which is costly and time-consuming.

SUMMARY

The object of the invention resides in proposing a holding frame for a heavy plug-type connector that corresponds to the industrial requirements mentioned.

The object is achieved by the subject matter as claimed. Advantageous embodiments of the invention are disclosed in the dependent claims.

The improved holding frame is designed for a heavy plug-type connector. Heavy plug-type connectors are used in particular in rough industrial environments. The holding frame may receive identical and/or different plug-type connector modules. Plug-type connector modules of this type may be configured for transmitting electrical, pneumatic or optical signals.

The plug-type connector modules essentially comprise a cuboid base body, the narrow sides of which are shaped with outward protruding latching lugs.

The holding frame comprises a base body that has in turn two side parts that lie opposite one another. The base body is configured in a frame-shaped manner. The side parts form the longitudinal sides of the base body. The side parts are connected to one another via corresponding narrow sides.

A fixing clip is held on at least one side part of the holding frame. The fixing clip fixes the plug-type connector modules within the base body in one plane. In so doing, the plug-type connector modules are encompassed the base body, as a result of which an overall stable arrangement is realized. The base body is preferably a zinc pressure die-cast component that is particularly robust.

However, the base body is advantageously produced from aluminum. As a consequence, the holding frame may be constructed in a particular light manner, as a result of which it is possible to reduce the weight of a heavy plug-type connector which is frequently perceived by the customers to be problematic. The higher price for the aluminum material could nonetheless be financially compensated by means of the simple construction of the holding frame.

It is preferred that the fixing clip is or the fixing clips are attached within the base body to the holding frame. As a consequence, a compact construction is realized and it is ensured that as the holding frame is installed in a plug-type connector housing there are no hindering elements protruding from the base body of the holding frame.

The at least one fixing clip comprises at least one holding arm that moves in a manner parallel to the plane of the side parts as the plug-type connector module is being inserted into the holding frame. It is preferred that the at least one fixing clip comprises two holding arms. The holding arms move in a manner parallel to the plane of the side parts as a plug-type connector module is being inserted into the holding frame. Moreover, in so doing the individual holding arms of the fixing clip move in opposite directions, in other words away from one another.

The holding arms comprise at their ends latching hooks. The latching hooks of one fixing element are oriented toward one another and as a result the upper insertion region of the fixing clip becomes narrower. If a plug-type connector module is inserted into the holding frame, the latching lugs of the plug-type connector modules are guided between the holding arms of the fixing clip. The narrowing insertion region causes the holding arms to be pushed in opposite directions away from one another. As soon as the latching lugs have passed the narrowing insertion region, the holding arms move back into their original position. The latching hooks are now located above the latching lugs of the plug-type connector module, as a result of which said plug-type connector module is fixed in the holding frame in a loss-proof and reversible manner. The plug-type connector modules are as a consequence latched in the holding frame.

It is preferred that the holding frame comprises multiple fixing clips. In this case, there are different variants for positioning the fixing clips on the side parts. Either at least one fixing clip each is held on both side parts of the holding frame. Alternatively, one fixing clip is held on one side part and at least two fixing clips are held on the other side part. A further alternative would be to hold at least two fixing clips on both side parts. In a particularly preferred embodiment, n fixing clips are held on one side part and m fixing clips are held on the other side part. The variables n and m represent in this case elements from the natural number range [0, 1, 2, 3 . . . ]. The variable n is in this case smaller than or equal to m.

Advantageously, the two side parts of the base body respectively comprise multiple connecting pieces that are preferably arranged lying opposite one another in a symmetrical manner. One open receiving arrangement respectively is formed between these connecting pieces. The latching lugs of the plug-type connector modules are located in these receiving arrangements. By virtue of the connecting pieces, the base body of the holding frame is provided with more material substance, as a result of which the mechanical stability of the holding frame is considerably increased overall.

In one advantageous embodiment, one fixing clip respectively is arranged in the region of the open receiving arrangement at least of one side part. Each receiving arrangement on the base body is fitted out in this case with a separate fixing clip. The individual fixing clip engages within the receiving region on the latching lugs of the plug-type modules.

In an alternative embodiment, the fixing clip comprises multiple holding arm pairs. One holding arm pair respectively is arranged in the region of the open receiving arrangement at least of one side part. In this case, the fixing clip extends over almost the entire length of the side part. In the region of the receiving arrangements, holding arm pairs, in other words two holding arms, protrude into same. These holding arm pairs function in a similar manner to the two holding arms that are formed on the individual fixing clip.

The holding arms or rather the holding arm pairs are arranged in the region of the receiving arrangements of the base body. If a plug-type connector module is inserted into a holding place provided for this purpose in the holding frames, then the latching lugs that are provided on the sides of the plug-type connector module push the holding arms that are located in the receiving arrangement to the side in a manner parallel to the side parts. In so doing, the holding arms deflect initially behind the connecting pieces of the base body. If the latching lugs of the plug-type connector module penetrate sufficiently far between the holding arms, the end regions of the holding frames engage over the latching lugs and in so doing latch the plug-type connector modules in the holding frame. In this case, the holding arms move back into their original position.

The fixing clip may be produced in any length with any number of holding arm pairs. The fixing clip may be manufactured as stamping-bending parts from a spring-elastic sheet metal plate. The fixing clip may also be produced from an elastic synthetic material, by way of example in an injection molding process. As a consequence, it is possible to achieve a particularly favorable construction of the holding frame. The fixing clip is configured from an elastic material. As the holding arms of the fixing clip are being deflected outward, a restoring force is created that urges the holding arms back into the original position.

It is preferred that at least one side part comprises one receiving arrangement or multiple receiving arrangements into which one fixing clip respectively may be inserted and as a result is held on the side part. As an alternative thereto, the at least one side part has one contour or multiple contours against which one fixing clip respectively may be clamped and as a result is held on the side part. By virtue of these two variants, the fixing clip may be fixed in a simple production procedure on the base body of the holding frame.

Advantageously, the fixing clip of the one side part is arranged lying opposite in a symmetrical manner with respect to the fixing clip of the other side part. Alternatively, the fixing clips of the one side part are arranged lying opposite in a symmetrical manner with respect to the fixing clips of the other side part. In another embodiment of the invention, the fixing clip of the one side part is arranged lying opposite in an offset manner with respect to the fixing clip of the other side part or the fixing clips of the one side part are arranged lying opposite in an offset manner with respect to the fixing clips of the other side part. In this case, the fixing clips are arranged in a zig-zag pattern within the base body of the holding frame, if one were to draw an imaginary connecting line between the fixing clips.

A similar symmetrical or off-set arrangement may also apply for the holding arm pairs that are located on one fixing clip that extends over a major part of the length of the side part.

BRIEF DESCRIPTION OF THE DRAWINGS

An exemplary embodiment of the invention is illustrated in the drawings and will be further explained below.

DETAILED DESCRIPTION

Figure 1:
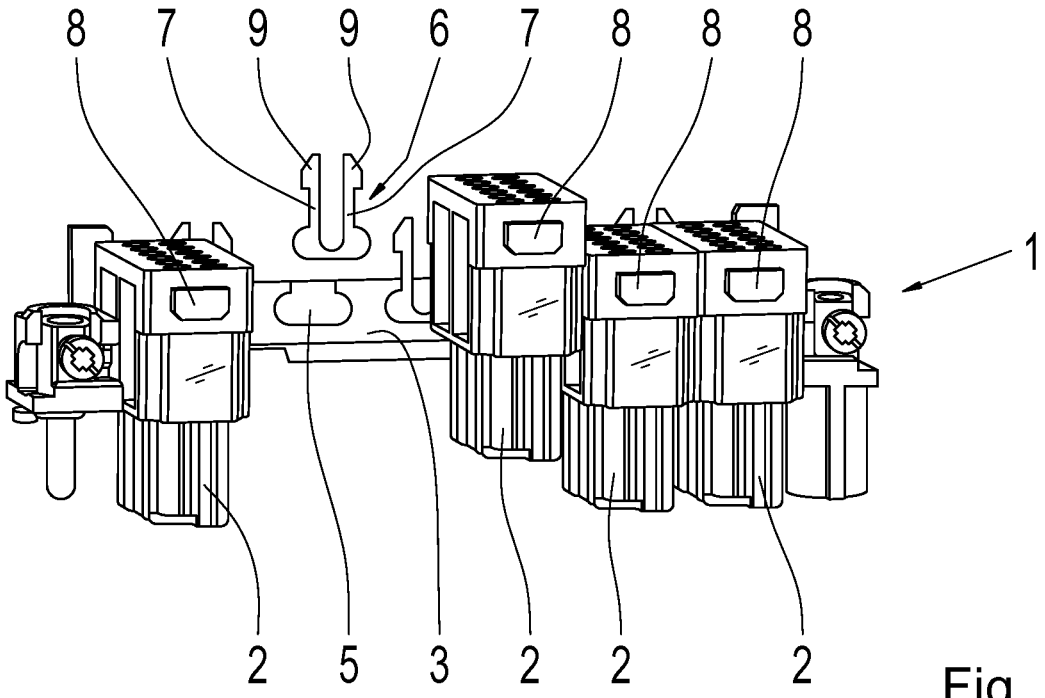
FIG. 1 illustrates a perspective view of a first embodiment of a holding frame having a side part that is not shown for illustrative reasons.

The figures show in part simplified, schematic illustrations. In part, identical reference numerals are used for identical but where appropriate non-identical elements. Different views of identical elements may be scaled differently.

Figure 2:
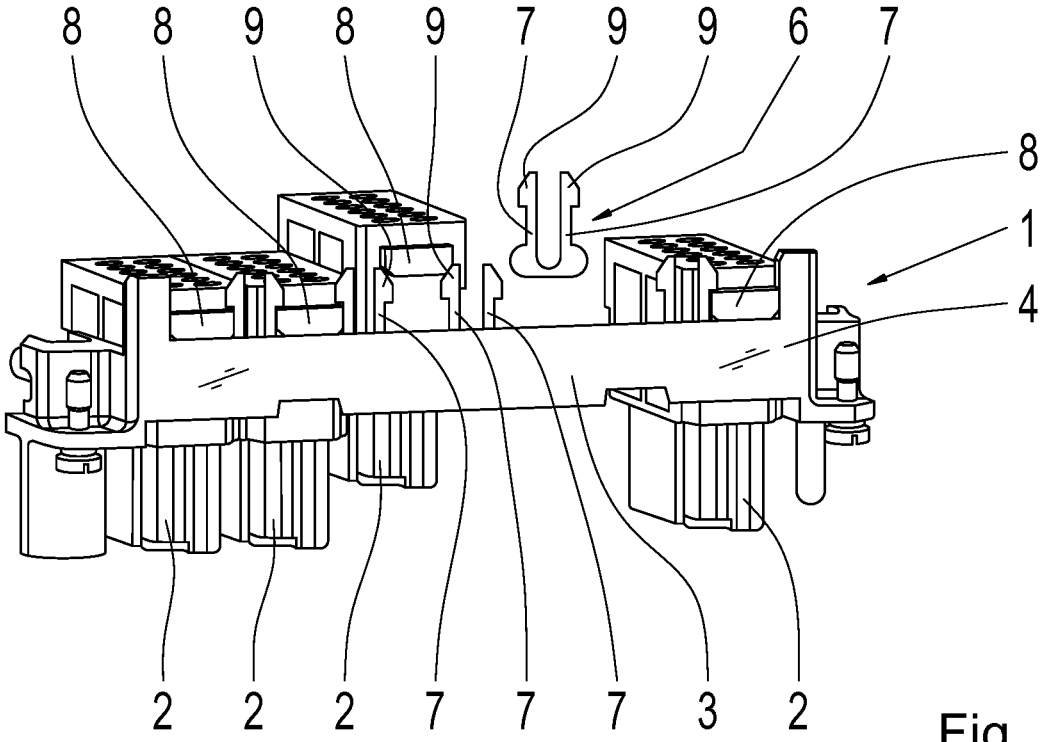
FIG. 2 illustrates a further perspective view of the first embodiment of the holding frame having a side part that is not shown for illustrative reasons.

FIGS. 1 and 2 illustrate a first embodiment of a holding frame 1. The holding frame 1 is configured for a heavy plug-type connector (not illustrated). Identical and/or different plug-type connector modules 2 may be used in the holding frame 1. The plug-type connector modules 2 fundamentally comprise a cuboid base body that has outwardly facing latching lugs 8 formed on its narrow sides.

The holding frame 1 comprises a base body 4 that has two side parts 3 that lie opposite one another. The base body 4 forms a frame-shaped structure. Receiving arrangements 5 are formed within this frame-shaped structure in the respective side parts 3 and one fixing clip 6 respectively may be inserted into said receiving arrangement and as a result may be fixed therein. The fixing clip 6 respectively comprise two holding arms 7. The holding arms 7 comprise on their end face outwardly oriented latching hooks 9. In the case of two fixing clips 6 that are arranged adjacent to one another, the end-face latching hooks 9 face one another.

As a plug-type connector module 2 is being inserted into the holding frame 1, the latching lugs 8 of the plug-type connector module 2 are guided between two holding arms 7 of two adjacent fixing clips 6. In so doing, the holding arms 7 are pushed to the side in a manner parallel to the side parts 3 on account of the latching hooks 9 that are making the insertion region narrower. If the latching lugs 8 pass out of the region of the latching hooks 9 by virtue of being further pushed in, the latching arms 7 spring back into their original position. Subsequently, the latching hooks 9 engage over the latching lugs 8 of the plug-type connector modules 2, as a result of which the plug-type connector modules 2 are fixed in the holding frame 1 in a loss-proof but reversible manner. In order to remove the plug-type connector modules 2, it is only necessary to bend the latching arms 7 of the fixing clip 6 away from the latching lugs 8 of the plug-type connector modules 2.

Figure 3:
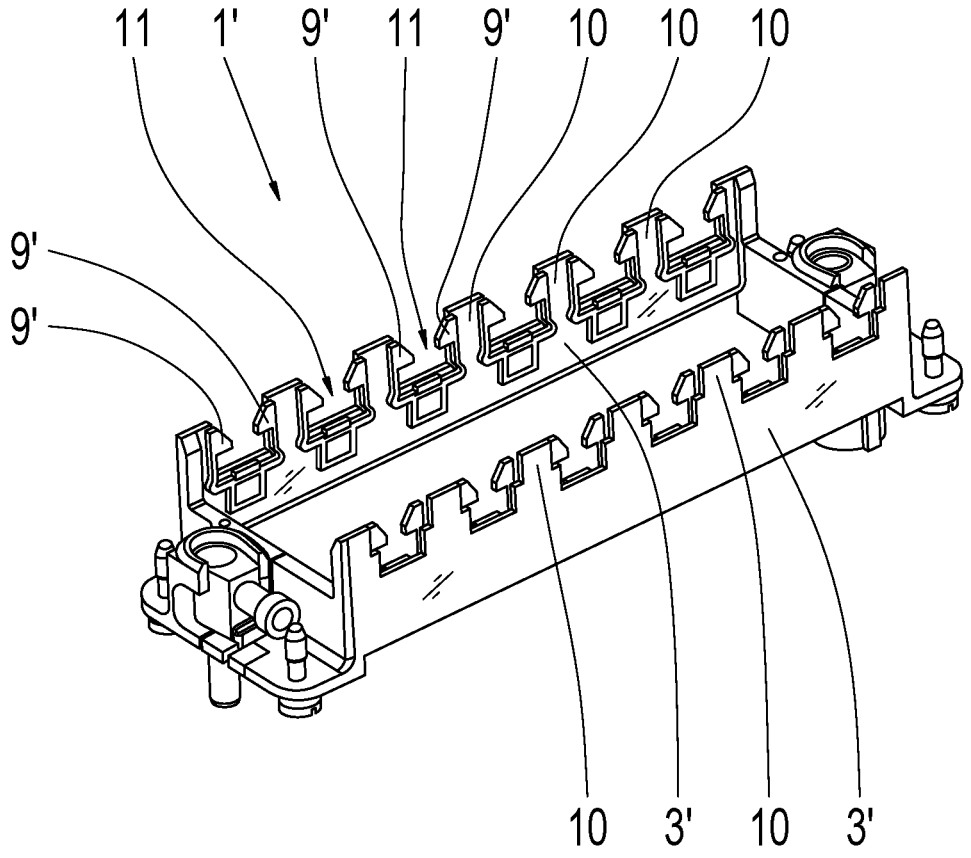
FIG. 3 illustrates a perspective view of a second embodiment of a holding frame.
Figure 4:
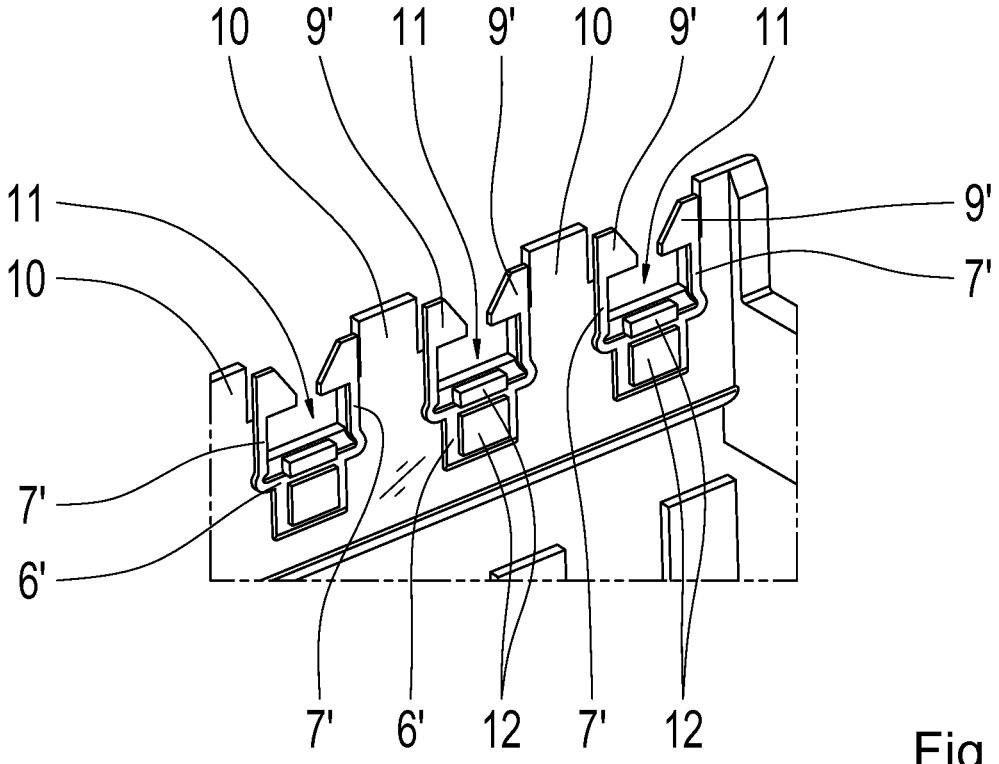
FIG. 4 illustrates a perspective detail of the second embodiment of the holding frame.

FIGS. 3 and 4 illustrate an alternative (second) embodiment of a holding frame 1' in accordance with the invention. For reasons of clarity of overview, the plug-type connector modules 2 are not shown here. It is possible to use and insert the same plug-type connector modules 2 as in the case of the above described first embodiment (FIGS. 1 and 2).

The holding frame 1' has a frame-shaped base body 4'. The two side parts 3' respectively comprise multiple connecting pieces 10 that are preferably arranged lying opposite one another in a symmetrical manner. Open receiving arrangements 11 are formed between these connecting pieces 10. A contour 12 in which one fixing clip 6' is held or rather fixed is located below these receiving arrangements 11 within the holding frame 1'.

The fixing clip 6' comprises two latching arms 7' having latching lugs 9' that are oriented facing one another.

As a plug-type connector module 2 is being inserted into the holding frame 1', the latching lugs 8 are pushed into the region of the open receiving arrangements 11 of the side parts 3'. In so doing, the latching hooks 9' of the holding arms 7' of the fixing clip 6' are bent away from one another in a manner parallel to the side walls 3'. If the latching lugs 8 pass out of the region of the latching hooks 9' by virtue of being further pushed in, the latching arms 7' spring back into their original position. Subsequently, the latching hooks 9' engage over the latching lugs 8 of the plug-type connector modules 2, as a result of which the plug-type connector modules 2 are fixed in the holding frame 1' in a loss-proof but reversible manner. In order to remove the plug-type connector modules 2, it is only necessary to bend the latching arms 7' of the fixing clip 6' away from the latching lugs 8 of the plug-type connector modules 2. As a consequence, the plug-type connector module 2 may be released and may be removed or rather replaced by another model.

Figure 5:
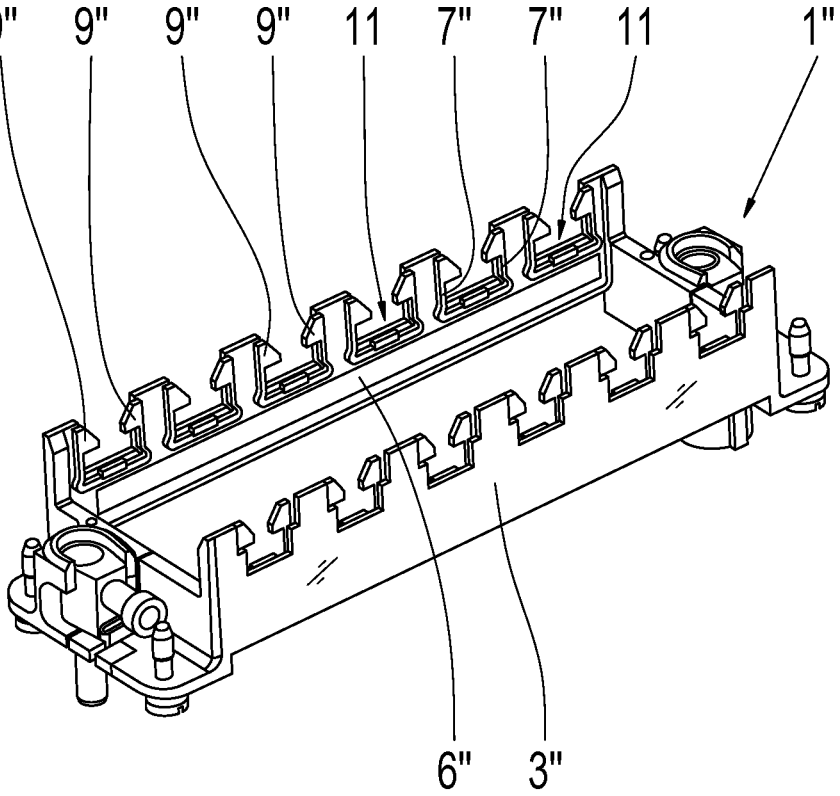
FIG. 5 illustrates a perspective view of a third embodiment of the holding frame.
Figure 6:
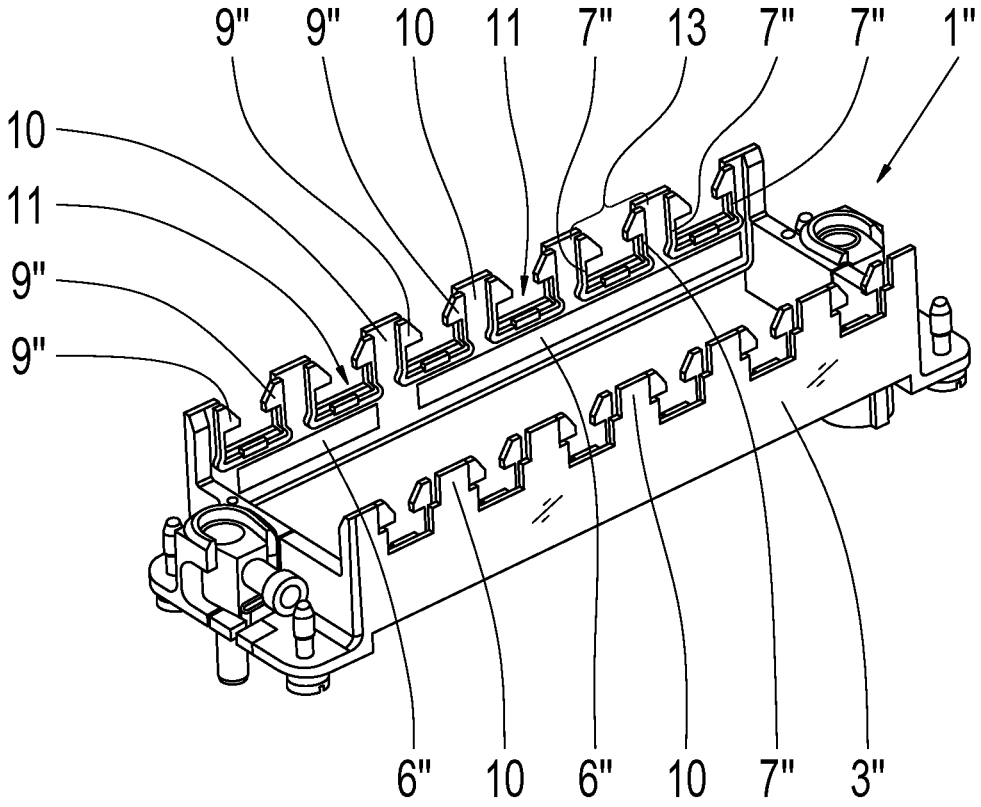
FIG. 6 illustrates a perspective view of a further method of the third embodiment of the holding frame.

FIG. 5 illustrates a third embodiment of a holding frame 1" in accordance with the invention. The base body 4" is likewise configured as in the case of the second embodiment. It is also possible to insert the same plug-type connector modules 2. The fixing clip 6" may comprise multiple holding arms 7". One holding arm pair 13 respectively is arranged in the region of a receiving arrangement 11 between the connecting pieces 10. The fixing clip 6" is fixed within the holding frame 1" on a contour (not illustrated). The fixing clip 6" may comprise any number of holding arms 7" or rather holding arm pairs 13. The fixing clip 6" may extend over the entire width of the side part 3". However, it is also possible to arrange two fixing clips 6" with a different number of holding arms along the side part 3" of the holding frame 1", as is illustrated by way of example in FIG. 6.

Figure 7:
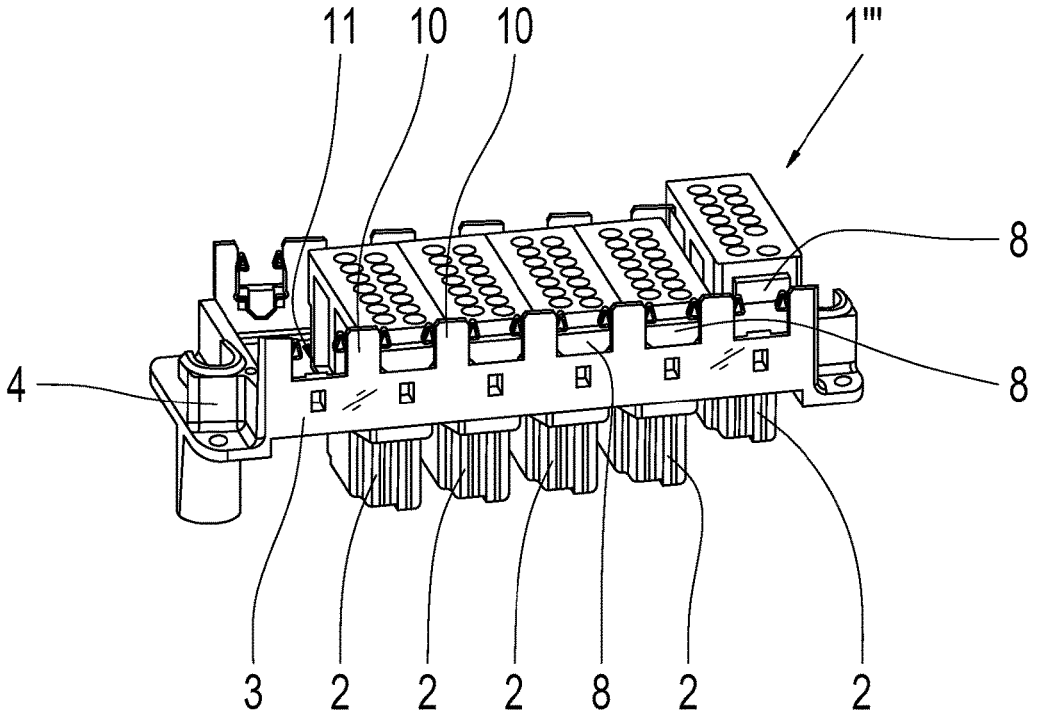
FIG. 7 illustrates a perspective view of a fourth embodiment of the holding frame.
Figure 8:
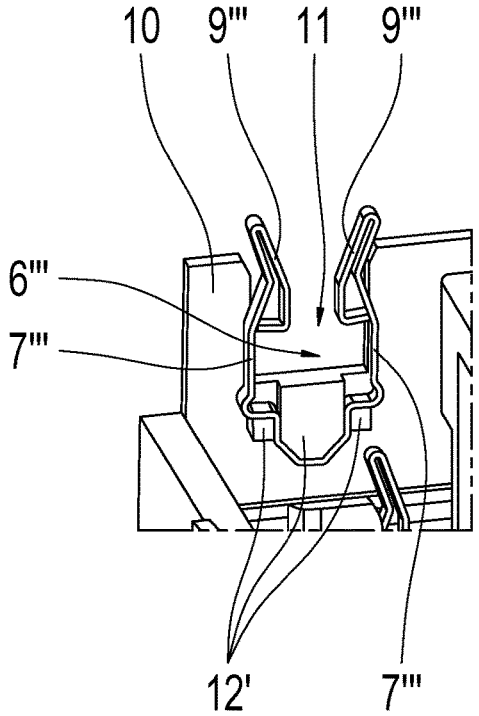
FIG. 8 illustrates a perspective detail of the fourth embodiment of the holding frame.
Figure 9:
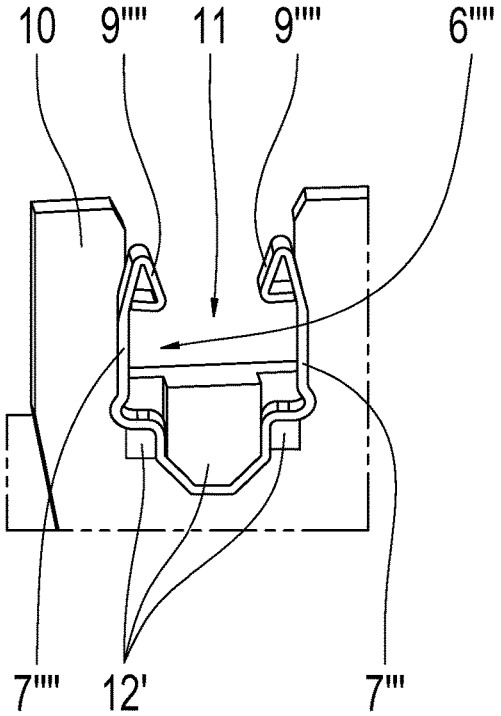
FIG. 9 illustrates a perspective detail of an alternative fourth embodiment of the holding frame.

FIGS. 7-9 illustrate a fourth embodiment of a holding frame 1'''. This embodiment may be fitted out with two alternative fixing clips 6''', 6'''' in the region of the receiving arrangements 11 of the side part 3 of the holding frame 1'''.

A first variant of one fixing clip 6''' is illustrated in FIG. 8. The fixing clip 6''' is arranged in the region of the receiving arrangement 11 of the side part 3 of the holding frame 1'''. The latching hooks 9''' that are arranged on the end face of the holding arms 7''' protrude in the case of this variant over the connecting pieces 10 of the side part 3. The latching hooks 9''' are slightly bent outward—away from one another—in the upper region. In addition to providing the fixing arrangement, the latching hooks 9''' also function as guiding means, as a result of which a plug-type connector module 2 may be inserted more easily. The latching lugs 8 of the plug-type connector module 2 are grasped by the latching hooks 9''', subsequently the holding arms 7''' are pushed to the side and finally grip the latching hooks 9''' so as to provide the fixing arrangement via the latching lugs 8 of the plug-type connector module 2.

Alternatively, the fourth embodiment of the holding frame 1''' is configured with a fixing clip 6'''', as illustrated in FIG. 9. The holding arms 7'''' are shorter in this case than the connecting pieces 10 of the side part 3 of the holding frame 1'''. As the holding frame 1''' is being fitted out, the latching lugs 8 of the plug-type connector module 2 move into the receiving arrangements 11 of the side part 3 and in so doing initially make contact with the latching hooks 9'''' of the fixing clip 6''''. As a consequence, the holding arms 7'''' are initially pushed away from one another. As the plug-type connector modules 2 are pushed further in, the latching lugs 8 pass out of the engagement region of the latching hooks 9''''. The latching hooks 9'''' may engage over the latching lugs 8 and in so doing pivot back toward one another. The latching hooks 9'''' now prevent the plug-type connector 2 moving in the opposite direction to the direction of insertion. The plug-type connector modules 2 may only be removed if the latching hooks 9'''' are pushed back away from one another, as a result of which the latching lugs 8 of the plug-type connector modules 2 are released.

In the case of the fourth embodiment of the holding frame 1''', the fixing clips 6''', 6'''' are fastened within the base body 4 on or rather with the aid of a contour 12'. As a consequence, the holding frame 1''' may be produced in an automated procedure in large numbers.

In the case of all the above described embodiments, the basis of the holding frame 1, 1', 1", 1''' is formed by a rigid base body 4 that serves as a stable framework. Fixing clips 6, 6', 6", 6''', 6'''' that are fixedly connected are to the base body 4 are inserted from inside in this base body 4. The plug-type connector modules 2 are encompassed by the base body 4 in the installed state. As a consequence, the system comprising holding frames 1, 1', 1", 1''' and plug-type connector modules 2 have a high degree of stability.

As a plug-type connector module is being inserted, the holding arms 7, 7', 7", 7''', 7'''' of the fixing clips 6, 6', 6", 6''', 6'''' are pivoted sideward, initially allowing the plug-type connector module 2 to pass through and subsequently snapping back together as soon as the plug-type connector module has achieved its end position in the base body 4. The plug-type connector module 2 is held between the holding arms 7, 7', 7", 7''', 7'''' of the fixing clips 6, 6', 6", 6''', 6'''' via its latching lugs 8. In so doing, the fixing clips 6, 6', 6", 6''', 6'''' may be configured from a round or rectangular wire or from a synthetic material.

Even if different aspects or features of the invention are each illustrated in combination, it is apparent for the person skilled in the art—unless otherwise stated—that the illustrated and discussed combinations are not the only combinations possible. In particular, units that correspond with one another or feature complexes from different exemplary embodiments may be used in lieu of one another.

LIST OF REFERENCE NUMERALS

1 Holding frame
2 Plug-type connector module

3 Side part
4 Base body
5 Receiving arrangement
6 Fixing clip
7 Holding arm
8 Latching lug
9 Latching hook
10 Connecting piece
11 Receiving arrangement
12 Contour
13 Holding arm pair

The invention claimed is:

1. A holding frame for a plug-type connector for receiving plug-type connector modules, comprising:

a base body that has two side parts that lie opposite one another and fixedly connected to one another at a predetermined distance in parallel planes; and at least one fixing clip which is held at least on one of the two side parts and by which at least one of the plug-type connector modules is fixed within the base body between the two side parts, wherein the at least one fixing clip and the base body are separately formed parts, and wherein the at least one fixing clip comprises at least one holding arm that as a plug-type connector module is being inserted into the holding frame moves parallel to the side parts at a constant distance from the plug-type connector module; wherein the at least one fixing clip comprises at least two holding arms that, as a plug-type connector module is inserted into the holding frame, move in a manner parallel to the side parts and in opposite directions to one another; wherein the at least two holding arms move away from each other as a plug-type connector module is inserted into the holding frame.

2. The holding frame as claimed in claim 1, wherein the holding frame comprises multiple fixing clips.

3. The holding frame as claimed in claim 1, wherein the two side parts respectively comprise multiple connecting pieces that are arranged lying opposite one another in a symmetrical manner, and wherein open receiving arrangements are formed between these connecting pieces.

4. The holding frame as claimed in claim 3, wherein one fixing clip respectively is arranged in a region of each of the open receiving arrangements at least of one side part.

5. The holding frame as claimed in claim 3, wherein each fixing clip comprises multiple holding arm pairs and one holding arm pair respectively is arranged in a region of each of the open receiving arrangements at least of one of the two side parts.

6. The holding frame as claimed in claim 1, wherein at least one of the two side parts comprises one receiving arrangement or multiple receiving arrangements into which one fixing clip respectively may be inserted and as a result is held on the side part.

7. The holding frame as claimed in claim 1, wherein at least one side part has one contour or multiple contours against which one fixing clip respectively may be clamped and as a result is held on the side part.

8. The holding frame as claimed in claim 1, wherein at least one fixing clip each is held on both side parts of the holding frame or one fixing clip is held on one side part and at least two fixing clips are held on the other side part, or at least two fixing clips are held on both side parts, or n fixing clip are held on one side part and m fixing clip are held on the other side part, wherein n and m elements are from the natural number range and n is smaller than or equal to m.

9. The holding frame as claimed in claim 8, wherein the fixing clip of the one side part is arranged lying opposite in a symmetrical manner with respect to the fixing clip of the other side part, or the fixing clips of the one side part are arranged lying opposite in a symmetrical manner with respect to the fixing clips of the other side part.

10. The holding frame as claimed in claim 8, wherein the fixing clip of the one side part is arranged lying opposite in an offset manner with respect to the fixing clip of the other side part, or the fixing clips of the one side part are arranged lying opposite in an offset manner with respect to the fixing clips of the other side part.

11. The holding frame as claimed in claim 1, wherein the fixing clip is or the fixing clips are attached within the base body to the holding frame.

12. The holding frame as claimed in claim 1, wherein the base body is formed from a zinc pressure die-cast component or produced from aluminum.

13. The holding frame as claimed in claim 1, wherein the fixing clip is or the fixing clips are produced from an elastic synthetic material or from a spring-elastic sheet metal plate.

14. A system, comprising a plug-type connector housing, the holding frame as in claim 1, and at least one plug-type connector module.

15. The holding frame as claimed in claim 1, wherein the at least one fixing clip extends upwardly above an upper edge of the at least one of the two side parts in which the at least one fixing clip is held.

* * * * *